United States Patent [19]

Ishikawa et al.

[11] 3,976,854

[45] Aug. 24, 1976

[54] CONSTANT-TEMPERATURE HEATER

[75] Inventors: Kazuo Ishikawa, Kadoma; Yoshio Irie, Nara; Hideo Mifune, Hirakata, all of Japan

[73] Assignee: Matsushita Electric Industrial Co., Ltd., Osaka, Japan

[22] Filed: July 31, 1974

[21] Appl. No.: 493,224

[52] U.S. Cl. ..... 219/505; 219/353; 219/468; 219/481; 219/540; 219/541; 219/553; 338/22 R

[51] Int. Cl.[2] ..... H05B 1/02; H05B 3/12; H01C 7/02

[58] Field of Search ..... 219/200, 210, 205, 301, 219/311, 338, 342, 345, 353, 356, 504, 505, 520, 526, 534, 535, 540, 541, 544, 552, 553, 465–468, 448, 481, 490; 338/13, 14, 20, 21, 22 R, 22 SD, 23–25, 28–30, 204, 205, 233, 229, 314, 322, 328, 329, 333, 334

[56] References Cited

UNITED STATES PATENTS

| | | | |
|---|---|---|---|
| 1,728,045 | 9/1929 | Dubilier | 338/24 |
| 2,606,986 | 8/1952 | Sweger | 338/23 X |
| 3,214,719 | 10/1965 | Turner | 338/22 R |
| 3,375,774 | 4/1968 | Fujimura et al. | 338/22 R |
| 3,584,189 | 6/1971 | Marcoux | 219/504 X |
| 3,720,807 | 3/1973 | Ting | 338/22 R |
| 3,748,439 | 7/1973 | Ting et al. | 338/22 X |
| 3,805,022 | 4/1974 | Kulwicki et al. | 219/504 X |
| 3,835,434 | 9/1974 | Kahn | 338/22 |

*Primary Examiner*—A. Bartis
*Attorney, Agent, or Firm*—Burgess Ryan and Wayne

[57] ABSTRACT

A constant temperature heater includes a thermistor having a positive temperature coefficient and a varistor stacked upon one another in an electrically insulating casing in such a manner that the thermistor and varistor are electrically connected in series with each other and the thermistor is in heat exchange relationship with a radiator plate on the casing. A spring in the casing presses the varistor and thermistor into firm engagement with each other and biases the thermistor into good heat conductive relation with the radiator plate. The varistor serves to reduce the transient currents in the thermistor and reduces the heat dissipation power of the thermistor, thereby providing a longer service life.

4 Claims, 7 Drawing Figures

CONSTANT-TEMPERATURE HEATER

BACKGROUND OF THE INVENTION

The present invention relates to a constant-temperature heater capable of maintaining the surface of a heat radiating plate or other similar heated member at a constant temperature.

A heating unit comprising a thermistor with a positive temperature coefficient connected in series with a power source has been used as a constant-temperature heater because its operation is free from voltage variation, its cost is low, and it has no contact. However, a heater assembly of this type has some inherent limitations. First, when the resistance of the thermistor with a positive temperature coefficient is decreased in order to attain higher heat dissipation power, the transient current is increased when a power switch is thrown. Secondly, the heat dissipation power of the thermistor per unit body volume is relatively low, so that a constant-temperature heater with a high heat dissipation power cannot be provided.

In general, the thermistor with a positive temperature coefficient used in a constant-temperature heater is pressed against a radiator plate by the force of a spring. However, the pressure exerted by the spring to the thermistor changes over a wide range from one constant-temperature heater to another because of the variation in dimensions of other component parts assembled with the thermistor and the spring. As a result, the surface temperature of the radiator plate changes over a wide range.

SUMMARY OF THE INVENTION

The present invention has for its object to provide a constant-temperature heater utilizing the self-heat dissipation of a thermistor with a positive temperature coefficient, the constant-temperature heater being best adapted for use as a heat source for a thermal chamber and as a heater for vaporizing insecticides and so on.

One of the objects of the present invention is therefore to provide a constant-temperature heater substantially free from the voltage variation.

Another object of the present invention is to provide a constant-temperature heater in which the transient current may be minimized, and the heat dissipation power of a thermistor with a positive temperature coefficient may also be reduced with the resultant long service life.

A further object of the present invention is to provide a constant-temperature heater in which the surface temperature of a radiator plate may be kept substantially constant.

According to one embodiment of the present invention, a thermistor with a positive temperature coefficient and a varistor are stacked one upon another in a casing in such a way that the thermistor may be located on the side of the opened end of the casing which is covered with a radiator plate. The thermistor and the varistor are pressed against the radiator plate under the force of a spring.

According to another embodiment of the present invention, a thermistor with a positive temperature coefficient is biased by a spring formed integrally with a terminal for connection with a power source, and an adjusting screw is provided for the spring so that the pressure exerted on the thermistor may be suitably adjusted.

DESCRIPTION OF THE PREFERRED EMBODIMENTS

Figure 1:
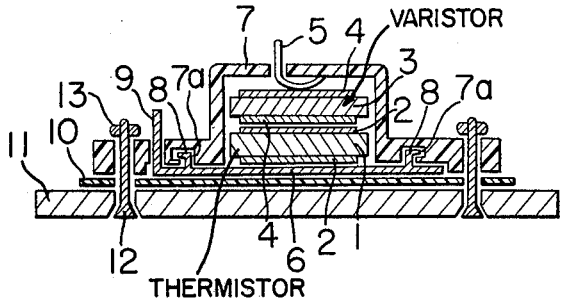
FIG. 1 is a longitudinal sectional view of a first embodiment of a constant-temperature heater in accordance with the present invention.
Figure 2:
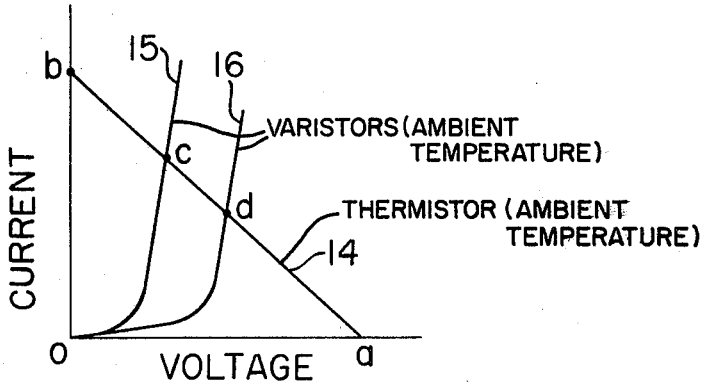
FIG. 2 is a view used for the explanation of the mode of operation of a varistor used in the first embodiment.
Figure 3:
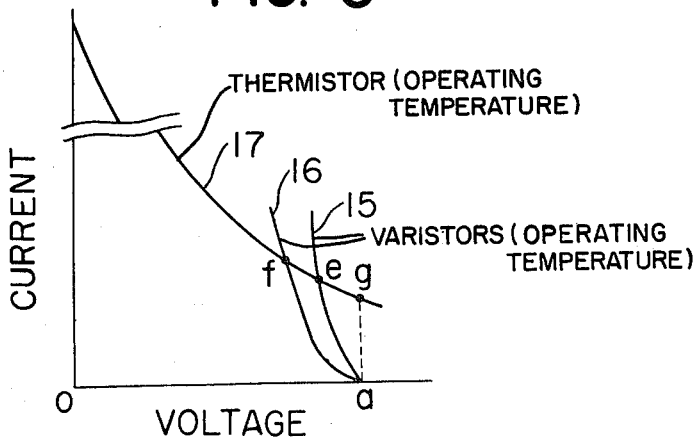
FIG. 3 is a graph used for the explanation of the mode of operation of the first embodiment.

First Embodiment, FIGS. 1, 2, and 3

Referring to FIG. 1 illustrating the first embodiment of the present invention, a varistor 3 with electrodes 4 is stacked upon a thermistor 1 with positive temperature coefficient and with electrodes 2, and is pressed against the latter under the force of a spring 5, which also serves as a terminal, so that the lower electrode 4 of the varistor 3 makes very intimate contact with the upper electrode 2 of the thermistor 1. The lower electrode 2 of the thermistor 1 makes intimate contact with a plate-shaped terminal 6 having inverse-L-shaped projections 8 extending upwardly and an upright extension 9, extending upwardly from one end of the plate-shaped terminal 6. A casing 7 has an inverted-U-shaped cross sectional configuration, and a flange in which are formed recesses *7a* for engagement with the projections 8 of the plate-shaped terminal 6, and is attached upon a heat radiator or sink 11, which also serves as a base of the constant-temperature heater, with bolts 12 and nuts 13 and with an insulating sheet 10 interposed between the heat radiator 11 and the plate-shaped terminal 6. An object to be heated is attached upon the undersurface of the base or heat radiator 11.

Next referring to FIGS. 2 and 3, wherein voltage is plotted along the abscissa while current, along the ordinate, the relation between the voltage and current and the heat-dissipation current and power in the transient period when transient current flows and in the steady state will be described hereinafter. In operation the terminals 5 and 9 are connected to a power source (not shown).

Referring first to FIG. 2, the load line 14 is drawn by drawing a line connecting the point *a* indicating the power source voltage and the point *b* which is obtained by dividing the power source voltage by the resistance of the thermistor 1 at an ambient temperature. The current-voltage characteristic curves 15 and 16 are of two varistors with different varistor voltages, and intersect the load line 14 at points *c* and *d*, respectively. When the varistor 3 is not inserted, the current *b* flows through the constant-temperature heater, but when the varistor 3 is inserted, the transient current may be decreased to the point *c* or *d*. The varistor with the characteristic curve 16 has a varistor voltage higher than the varistor with the characteristic curve 15.

Next referring to FIG. 3, the voltage-current characteristics in the steady state will be described. The voltage-current characteristic curve 17 is of the thermistor while the voltage-current characteristic curves 15 and 16 are of the varistors.

When the varistors were not inserted, current *g* would flow, but when the varistor with the characteristic curve 15 is inserted, the current flowing is increased to the point *e*. When the varistor with the characteristic curve 16 and with a higher varistor voltage is inserted, the current flow is further increased to the point *f*. In summary, as the varistor voltage is increased, the heat-dissipating power is increased.

When a thermistor with a positive temperature coefficient is connected in series to a varistor, and the varistor and thermistor are connected in series to the power source, the transient current may be decreased while the steady-state heat-dissipation power may be increased. Since both the thermistor and varistor are of the body resistor type, the electrical connection therebetween may be attained in a simple manner by pressing them together. Moreover, the constant-temperature heater may be made compact in size.

The advantages of the first embodiment may be summarized as follows:

a. The transient current may be reduced.
b. The stabilized power may be increased.
c. By the combination of the characteristics of the thermistor with a positive temperature coefficient with the varistor, the magnitudes of the transient current and stabilized power may be easily adjusted.
d. The construction is very simple.
e. The constant-temperature heater may be made compact in size.
f. The fabrication cost is less because the mass production of thermistors and varistors is feasible.

Second Embodiment, FIGS. 4 through 7

Figure 4:
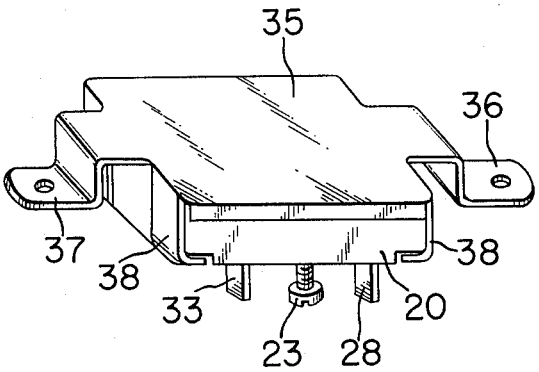
FIG. 4 is a perspective view of a second embodiment of the present invention.
Figure 5:
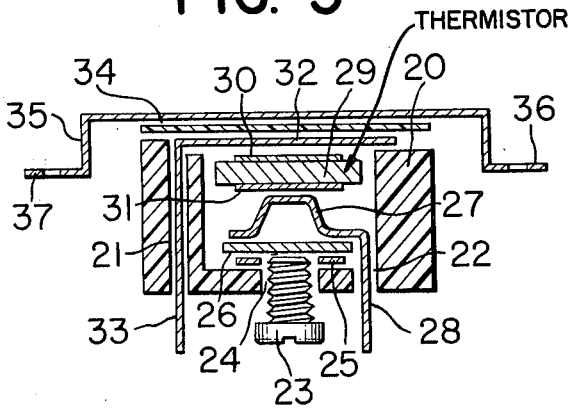
FIG. 5 is a longitudinal sectional view thereof.
Figure 6:
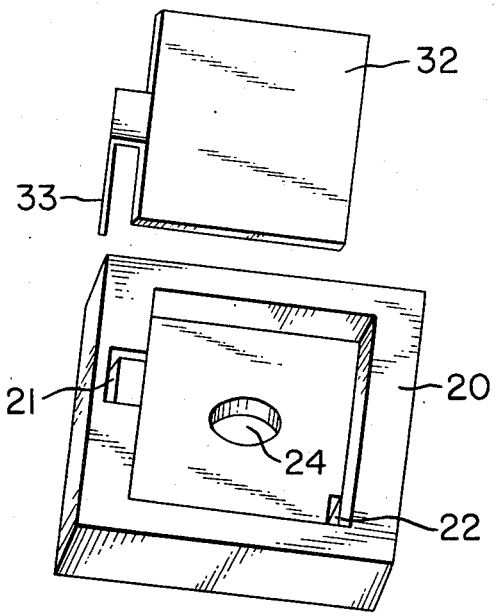
FIG. 6 is a perspective view of a casing and one terminal thereof.

Referring to FIGS. 4 through 6 and especially FIG. 5, a casing 20 made of a heat resisting electrically insulating resin or porcelain has a through hole 21 extending through one side wall thereof as best shown in FIG. 5, and another through bore 22 and a center aperture 24 formed through the bottom thereof.

Referring to FIG. 5, an adjusting screw 23 extends into the center aperture 24 and is screwed to a nut 25 disposed within the casing 20, so that the adjusting screw 23 is prevented from falling off. The upper end of the adjusting screw 23 contacts the undersurface of a pressure plate 26 made of a steel or the like. A leaf spring 27, formed integrally with a terminal 28 depending from one end thereof and extending through the through bore 22 of the casing 20 is interposed between the pressure plate 26 and the lower electrode 31 of a thermistor 29. A terminal plate 32 made of stainless steel, copper, steel or the like and formed integrally with a terminal 33 depending from one end thereof and extending downwardly through the thorough bore 21 formed through one side wall of the casing 20, makes intimate contact with the upper electrode 30 of the thermistor 29. A heat-resisting electrical insulating sheet made of mica, silicon rubber or the like is interposed between the upper surface of the terminal plate 32 and a heat radiator or sink 35. As best shown in FIG. 4, the heat radiator 35 has a pair of horizontal projections 36 and 37 formed integral therewith for attachment, and a plurality of depending elongated projections 38 which are bent over the casing 20 after the latter is mounted upon the heat radiator or sink 35 so that the casing 20 and the heat radiator 35 may be assembled into a unitary construction.

A voltage of 100 volts is applied across the terminals 28 and 33, so that the thermistor 29 starts to dissipate heat. When the pressure exerted from the leaf spring 27 to the thermistor 29 is varied by tightening or loosening the adjusting screw 23, the surface temperature of the radiator 35 changes as shown in FIG. 7.

Figure 7:
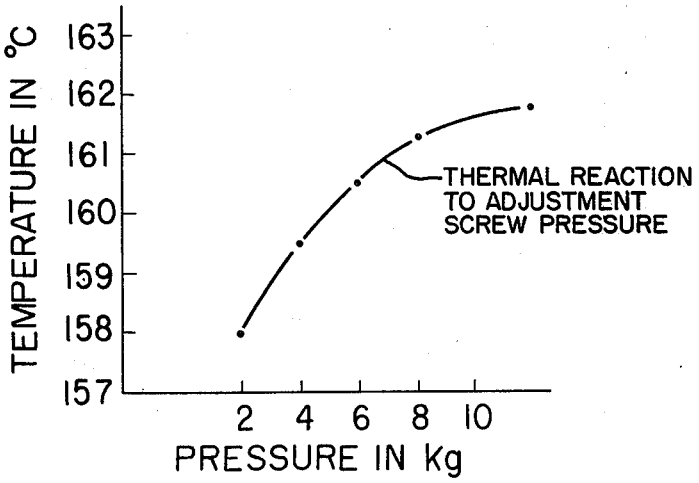
FIG. 7 is a graph illustrating the relation between the surface temperature of a radiator plate and the pressure exerted to the thermistor from a spring.

The temperature-pressure characteristic curve shown in FIG. 7 was obtained when were used a thermistor of 18 mm in diameter and 3 mm in thickness with a positive temperature coefficient, that is a resistance-temperature coefficient of 20%/°C, a switching temperature of 180°C, and the electrodes formed by a aluminum-spraying; a radiator made of a stainless steel 35 mm in length, 25 mm in width and 0.5 mm in thickness; and a casing made of alumina and 10 mm in depth.

As shown in FIG. 7, the surface temperature of the radiator 35 changes as the pressure exerted to the thermistor 29 from the leaf spring 27 changes. However, even when leaf springs with the same spring constant and same dimensions are used, the pressure exerted on the thermistor changes over a wide range because of the variation in dimensions of other associated component parts. However, according to the present invention, the adjusting screw 23 is provided so that the surface temperature of the radiator 35 may be precisely adjusted even when there is a product variation in dimensions of various component parts. Moreover, the pressure exerted on the thermistor 29 may be decreased by the adjusting screw 23 so that the transient current may be reduced, and thereafter the adjusting screw 23 is turned through an angle which may be read through a graduated scale (not shown), thereby bringing the surface temperature of the radiator to a desired temperature.

What is claimed is:

1. A contant-temperature heater comprising an electrically insulating casing having an open end and a closed end opposite the open end, a heat source comprising a thermistor with a positive temperature coefficient of resistance and having electrodes formed on at least two major surfaces thereof, a varistor having electrodes formed on at least two major surfaces thereof, said thermistor and said varistor being stacked upon one another within said casing such that an electrode on one major face of said varistor is in electrical contact with an electrode on one major face of said thermistor so that said varistor and thermistor are electrically and thermally in series with said varistor disposed at the closed end of the casing and said thermistor disposed at the open end of said casing, and a radiator plate covering the open end of said casing in opposed relationship with said thermistor, a first terminal for said heater on the closed end of said casing, an elastic electrically conductive member interposed between the closed end of said casing and the electrode on the other major face of said varistor for biasing said thermistor against said radiator plate through said varistor and electrically connecting said first terminal to said last mentioned electrode, an electrically insulating sheet interposed between the thermistor and the radiator plate, a plate-shaped terminal in physical and electrical contact with the electrode on the other major face of said thermistor and forming a second terminal for said heater, and said insulating sheet comprising a heat-resisting electrical insulating sheet interposed between said plate-shaped terminal and said radiator plate, whereby said radiator plate is electrically insulated from said thermistor and in good thermal relationship therewith so as to receive heat from said thermistor for dissipation.

2. A constant-temperature heater comprising a thermally conductive heat radiator having a first surface, an electrically and thermally insulating layer on said first surface, a conductive plate terminal on the side of said layer away from said radiator, a heat source comprising a thermistor having first and second electrodes on first and second opposite major surfaces thereof, said thermistor being positioned with said first electrode engaging said plate terminal, a varistor having third and fourth electrodes on opposite major faces thereof, said varistor being stacked on said thermistor with said third electrode contacting said second electrode, an electrically insulating casing on the side of said radiator toward said thermistor and enclosing said thermistor and varistor, means fixedly holding said casing in position with respect to said radiator, terminal means on said casing adjacent said fourth electrode, and including a spring extending between the inside of said casing and said fourth terminal, whereby said terminal means is electrically connected to said fourth terminal and said spring mechanically biases said varistor toward said thermistor and mechanically biases said thermistor toward said radiator, whereby said radiator is electrically insulated from said first electrode and in good thermal relationship with said thermistor to receive heat therefrom, said plate terminal and terminal means comprising the electrical terminals for said heater.

3. The constant-temperature heater of claim 2 wherein said plate terminal has first upright extensions on the side thereof away from said radiator, and said casing has recesses in the side thereof toward said radiator and engaging said first projections for holding said casing to said plate terminal.

4. The constant-temperature heater of claim 3 further comprising a projection extending from the side of said plate terminal opposite said radiator, said projection extending through said casing and forming an external terminal for said heater.

* * * * *